United States Patent [19]

Lumsden et al.

[11] 4,413,162

[45] Nov. 1, 1983

[54] MOVING COIL TRANSDUCERS USING MULTIPLE-STRANDED COILS

[75] Inventors: Stuart W. Lumsden; Matthew S. Polk, both of Baltimore, Md.

[73] Assignee: Polk Audio, Inc., Baltimore, Md.

[21] Appl. No.: 383,233

[22] Filed: May 28, 1982

[51] Int. Cl.[3] ..... H04R 9/00; H04R 9/04

[52] U.S. Cl. ..... 179/115.5 VC; 179/115.5 R; 179/115.5 DV

[58] Field of Search ..... 179/115.5 DV, 115.5 VC, 179/115.5 ES, 115.5 R

[56] References Cited

U.S. PATENT DOCUMENTS 2,925,541 2/1960 Koch ..... 179/115.5 VC

DV 4,300,022 11/1981 Hasting-James et al. ..... 179/115.5

*Primary Examiner*—G. Z. Rubinson

*Assistant Examiner*—Danita R. Byrd

*Attorney, Agent, or Firm*—Cushman, Darby and Cushman

[57] ABSTRACT

A moving coil transducer such as a loudspeaker has its coil formed of multiple strand or litz wire. The structure includes a form having multiple turns of the stranded wire thereon, and the leads or ends of the stranded wire forming the coil extend continuously from the moving coil structure to attachment or terminal means carried on some portion of a fixed structure associated with the moving coil. The multiple strand wire is twisted to a predetermined lay throughout its length.

2 Claims, 6 Drawing Figures

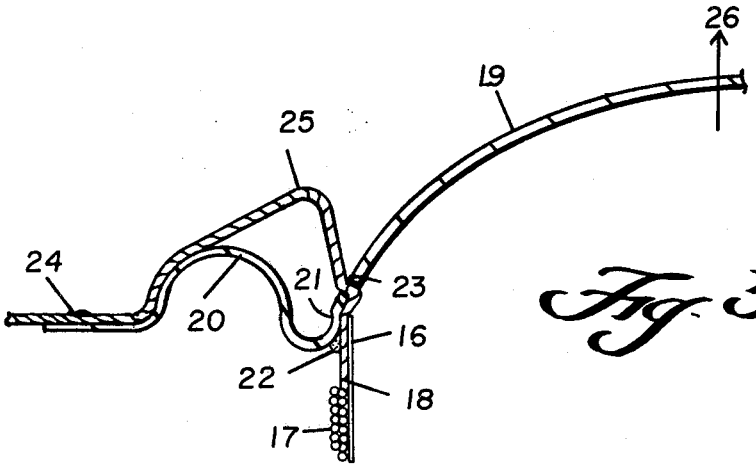
Fig. 3
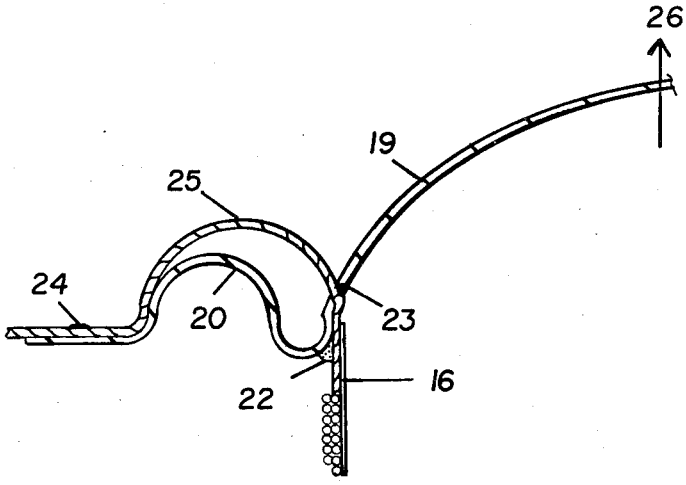
Fig. 4
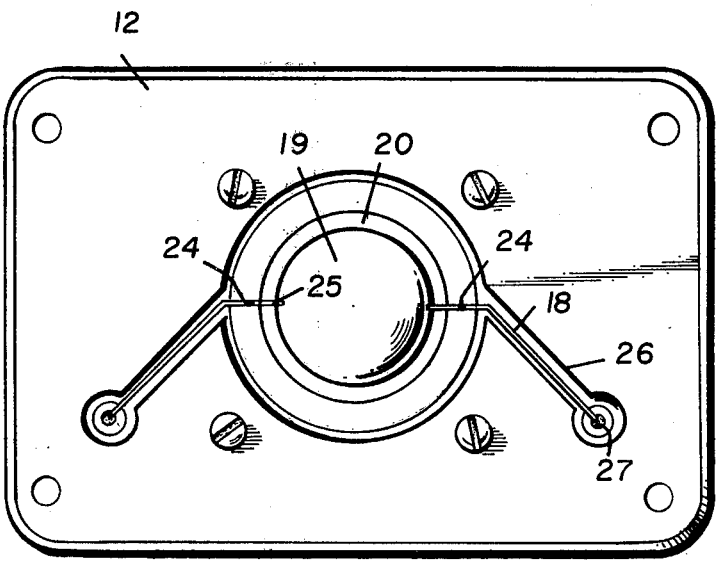
Fig. 5
Fig. 6
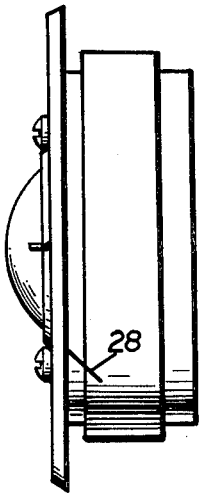

MOVING COIL TRANSDUCERS USING MULTIPLE-STRANDED COILS

BACKGROUND OF THE INVENTION

This invention relates to a moving coil transducer in which the moving coil is wound of multiple strand or litz wire.

In the prior art, in a moving coil transducer such as a loudspeaker, the voice-coil is wound of a solid wire, which is then connected to intermediate conductors somewhere on the moving parts of the mechanical system. The moving parts usually consist of a voice coil, diaphragm, and some sort of suspension. The intermediate conductor is then used to make the physical and electrical connections either to the input terminals of the unit or to some intermediate point on the fixed structure. The connections made between the intermediate and coil wires are usually soldered and fastened to the moving system in some manner such as gluing. Rising labor costs and the high degree of skill necessary to perform this task properly are disadvantages of such a construction. Such a construction also requires close inspection to insure against faulty solder joints and damage to the diaphragm or suspension.

The intermediate conductor used in such prior art constructions is usually braided or stranded and of a larger wire gauge than the solid voice-coil wire. The intent in using a heavier conductor which is braided or stranded is to increase its resistance to flexural strain which could lead to work hardening and consequent breakage. In that respect, such a design is effective. However, the high mass of the intermediate conductor and that of the solder and associated materials which remain on the moving parts increases the moving mass of the system. The increase in mass makes no contribution to the surface area or structural integrity of the diaphragm and tends to increase distortion and degrade the performance of the unit. Some designs call for a total moving mass which is very small and diaphragms which are thin and somewhat pliant. These moving systems may be required to accelerate and decelerate extremely fast. The use of intermediate conductors in such a system increases mass and mechanical resistance. This will reduce the ratio of force to mass, causing a reduction in efficiency and reduced ability to operate at high frequencies. The excess mass may also cause high distortion in light weight, flexible diaphragms through premature nodal and harmonic break-up.

Another prior art method that has been employed in the manufacture of high frequency moving coil transducers involves the continuation of the solid voice coil wires from the coil to the input terminals where the electrical and physical connections are made. This technique usually involves special wire geometries which are intended to reduce the effects of work hardening and flexural strain on that portion of the wire which extends from a fixed position on the moving part to a fixed position on the non-moving part of the mechanical system. Often, the restrictions of space within the transducer unit inhibit both the design and feasible implementation of wire configurations which are effective in reducing the strain to acceptable limits. Even when used in the best contemporary designs, the solid wire is inherently prone to breakage due to concentrated stress at its fixed points.

OBJECTS AND SUMMARY OF THE INVENTION

Accordingly, an object of the invention is to provide a novel design for the construction of moving coil transducers in which there is no need for intermediate connections between the coil and the electrical inputs.

A further object of the invention is to provide a conductor which may be used continuously as coil and connecting wire in a moving coil transducer, the conductor being constructed so as to insure long life for the unit.

Another object of the invention is to provide a novel moving coil transducer construction wherein the moving mass is minimized.

A still further object of the invention is to provide a moving coil transducer construction wherein the manufacturing process is simplified so as to reduce costs and lower reject rates.

Yet another object of the invention is to provide a moving coil transducer which exhibits improved high frequency performance.

Yet another, and still further object of the invention is to provide moving coil transducers whose coil windings exhibit improved adhesion to the coil form and within the coil itself.

In accordance with an embodiment of the invention in its broader form, a moving coil transducer assembly is provided which includes a rigid mounting structure of some type along with a stationary magnetic structure. A moving coil structure is mounted for movement with respect to the mounting structure and stationary magnetic structure. The coil is a stranded wire having a plurality of individual conductors. In accordance with some preferred embodiments of the invention, the wire extends continuously from the moving coil structure to attachment or terminal means carried on some portion of the fixed structure i.e., the rigid mounting structure or frame. Also in accordance with some preferred embodiments, the multiple conductor wire is twisted to a predetermined lay throughout its length.

BRIEF DESCRIPTION OF THE DRAWINGS

FIGS. 3 and 4 are enlarged cross-sectional views of a portion of the voice coil and suspension/diaphragm structure of the speaker of FIG. 1, showing alternative embodiments for routing the wire forming the voice coil across the suspension.

FIG. 5 is a front elevational view of a speaker constructed in accordance with the present invention.

FIG. 6 is a side elevational view of the loudspeaker of FIG. 5.

DESCRIPTION OF THE PREFERRED EMBODIMENTS

Figure 1:
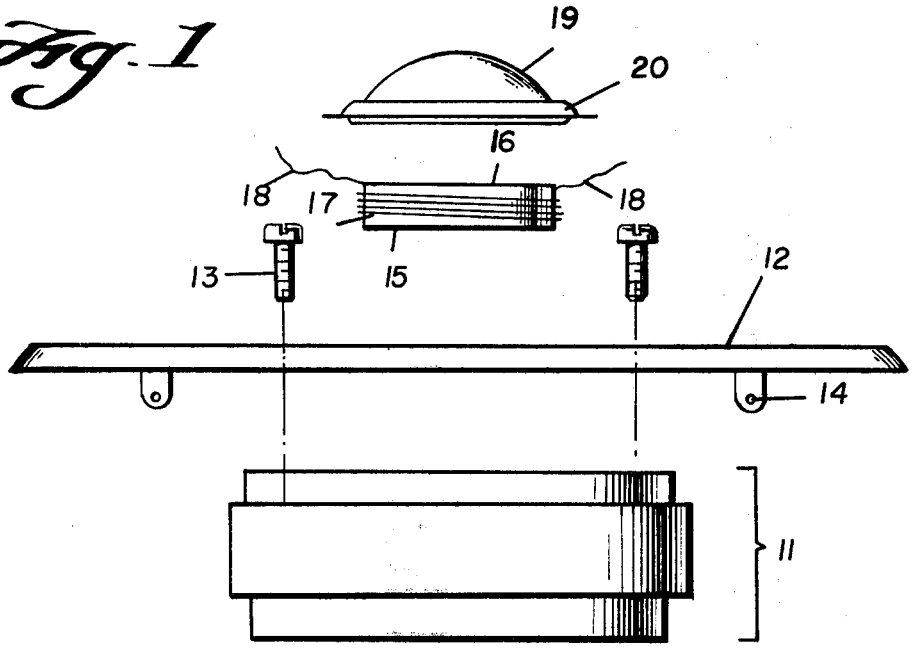
FIG. 1 is an exploded side elevation of a loudspeaker construction in accordance with the principles of the present invention.

Referring to FIG. 1, there is shown an exploded view of a moving coil transducer in accordance with the invention, in this particular case a loudspeaker for reproduction of audio high frequency signals. Such a loudspeaker construction includes a stationary magnetic structure 11 to which a frame 12 is secured by suitable means such as screws 13. As shown in FIG. 1, the frame can carry terminal means 14. A voice coil assembly 15 is formed of a coil form 16 which has a plurality of turns of wire 17 wound thereon with the wire being brought out in coil leads 18.

Suitably secured to the coil assembly 15 is a suspension/diaphragm structure comprising a diaphragm 19 and suspension 20. In accordance with conventional techniques, the voice coil assembly 15 and the diaphragm/suspension structure 19 and 20 are secured together, and the suspension 20 is suitably secured to the frame 12 by means such as adhesive. The voice coil assembly 15 extends down into the magnetic structure 11. In response to electrical signals within the voice coil assembly 15, the voice coil assembly 15, and hence the diaphragm 19, are physically displaced for audio sound reproduction.

Figure 2:
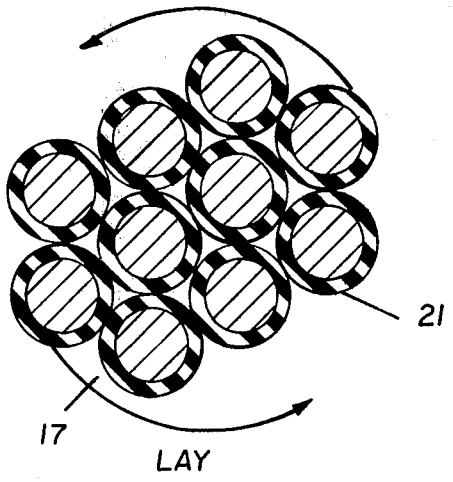
FIG. 2 is a cross-sectional view of the stranded wire forming the voice coil in the speaker construction of FIG. 1.

Turning now to FIG. 2, there is shown a cross-section of the wire 17 used for the voice coil and coil leads in accordance with the present invention. As can be seen from FIG. 2, the wire 17/18 is a stranded wire or litz wire comprising a plurality of individual conductors 21. As shown in FIG. 2, in accordance with a preferred embodiment of the invention, each of the individual conductors 21 is insulated, although it is considered to be within the scope of the invention to use uninsulated individual conductors. The cross-sectional area of the multi-strand wire 17/18 is of course the sum of the areas of the individual conductors 21. The cross-sectional areas should be chosen for a particular application to a particular loudspeaker assembly so that the area is equal to that of the solid wires which have normally been used in conventional prior art loudspeaker construction.

Using an arrangement such as shown in FIG. 2, the moving coil assembly 15 has improved current-carrying characteristics at high frequencies due to reduced skin effect, while it retains the low frequency current carrying abilities that the same coil would have if formed with a solid wire in accordance with the prior art techniques. In accordance with one particular preferred embodiment of the invention, the multiple strand wire 17/18 is made up of ten strands of #50 A.W.G. solid copper wire. Such a composite construction is comparable in cross-section to a #40 A.W.G. solid conductor; however, the surface area of the litz or multi-stranded wire 17/18 is approximately 216% greater than that of the equivalent area solid wire. In accordance with a preferred embodiment, the lay of the litz or stranded wire 17/18, being the interval at which the conductor as a whole is twisted, is no less than ⅛ inch and no greater than ½ inch. The particular desirable lay will of course depend upon the number of individual conductors and their size in the particular application.

The construction described above in accordance with the invention maximizes the conductor's flexibility and resistance to breakage due to work hardening by twisting and selecting the greatest number of strands for the litz wire within economical and technological limits.

In accordance with an important aspect of one embodiment of the invention, the use of the multi-strand conductor in the windings of coils used in moving coil transducers provides for improved performance of the unit at high frequencies due to the "litz effect" of the multi-strand conductor. Also, the multi-strand conductor has a greater surface area than an equivalent cross-sectional area solid conductor, and as such provides a means for winding coils for moving coil transducers which are more solidly bonded both to the coil form and within the plurality of windings forming the coil.

In accordance with other important aspects of the invention, use of a multiple stranded conductor provides a coil and coil leads which are flexible enough to tolerate the repeated flexure inherent in a moving coil transducer without failure from work hardening and consequent breakage. Also, in accordance with an important aspect of one embodiment of the invention, the multiple strand conductor is used in a continuous fashion for both the coil and hook-up wire between the moving and non-moving parts of the mechanical system. This obviates the need for tedious and costly soldering operations in loudspeaker assembly and also provides an arrangement for the construction of moving coil transducers wherein the effective mass of the moving system is minimized.

Referring now to FIGS. 3 through 6, some of these important aspects of the present invention are illustrated. FIGS. 3 and 4 are enlarged partial sections of a portion of the suspension/diaphragm, voice coil structure showing the manner in which the voice coil leads are routed and affixed to portions of the structure. As shown in the drawings, the assembly is made by folding the coil leads 18 inside the diameter of the coil over the top of the coil form 16 and fitting this end of the coil assembly 15 inside the voice coil diameter portion 21 of a dome type diaphragm/suspension assembly comprising diaphragm portion 19 and suspension portion 20. The coil assembly and the diaphragm/suspension 19/20 are affixed together with a small amount of a temperature resistive adhesive 22. This construction captures the voice coil lead 18 between the diaphragm 19 and the voice coil form 16 by the glue bond 22. The coil wire 18 exits through a hole in the diaphragm material pierced at the location indicated by reference numeral 23. The hole is sealed and the wire fixed by the application of a flexible adhesive at this location 23. Suitable flexible adhesives are known to those in the loudspeaker art. In accordance with the invention the same coil lead wire 18 is then routed from the location 23 to a location or attachment point 24 by means of a loop 25. FIGS. 3 and 4 illustrate different possible shapes for the loop 25. A high degree of variability in the loops 25 is acceptable without any effect on the performance or longevity of the assembly. The considerations that need to be kept in mind in forming the loop 25 are that the length of wire in the loop 25 should be greater than the length of material in the suspension 20. This is so because it is not desired to have any stress on the loop 25 even if the suspension 20 is fully extended. Secondly, the wire loops 25 should be in the plane which includes the central axis of motion of the diaphragm/suspension unit, indicated by reference numeral 26 in FIGS. 3 and 4.

The construction such as shown in FIGS. 3 and 4 is greatly simplified when compared to the conventional construction which involves the problems of soldering the coil leads to other conductors, or constructing complicated geometries for the conductor in the area under the suspension 20. This construction as described in connection with FIGS. 3 and 4 is also preferred because it eliminates the heavier intermediate conductors and soldering materials from the moving system of the moving coil loudspeaker, thus minimizing its effective mass.

FIGS. 5 and 6 show a completed moving coil transducer unit in accordance with the preferred embodiment of the invention. Following attachment point 24 of the loop 25, the multi-stranded conductor is continuously run through a recessed path 26 in the frame 12 to a hole 27 therein. An input terminal 28 is eyeleted into the hole 27. The lead wire extends through the hole 27 and is soldered to the input terminal 28. The path of the lead wire through the recessed path 26 is then filled with an adhesive to cover and secure the wire 18 and its passage therethrough.

A particular aspect and preferred embodiment of the present invention has been described with reference to application of the principles of the invention to a moving coil transducer comprising a loudspeaker. The invention in its broadest aspects, however, is applicable to other moving coil transducers. Such other applications include, for example, position sensing devices used in automation and robotics which use moving coils to detect motion or relative position; computer components which employ moving coil transducers to position or locate data collecting and distributing instruments; proximity devices which use moving coil transducers to collect reflected pressure or electromagnetic wave information; or audio cartridge pick-ups, which use moving coil transducers to translate vibrational energy into audio signals. In all such applications, use of a multiple strand or litz wire increases the high frequency performance while providing a greater surface area for bonding of the coil in the moving coil transducer. Additionally, use of a continuous multi-stranded or litz wire for forming the coil and the leads which are connected to a fixed or stationary point of the structure, enables the mass of the moving coil transducer to be minimized while at the same time providing a construction which maximizes the flexibility and resistance to breakage due to work hardening. Thus, although the invention has been described in connection with a preferred embodiment, it is clear that the invention is not limited to that preferred embodiment and it is intended in the following claims to define the true scope of the invention.

We claim:

1. A moving coil transducer including a rigid mounting structure and a stationary magnetic structure, a moving coil structure mounted on said rigid mounting structure, said moving coil structure having a diaphragm means adapted to move with respect to said mounting structure and stationary magnetic structure in response to electrical signals within said coil structure whereby the moving coil transducer functions as a loudspeaker, said coil structure comprising at least one turn of wire, said wire extending from the coil in leads having first and second ends, said wire comprising a stranded wire having a plurality of individual conductors, said rigid mounting structure having terminal means thereon, said wire leads extending continuously from the coil structure through apertures in said diaphragm means to said terminal means, said wire being twisted to a predetermined lay within a range from and including $\frac{1}{8}$ inch to and including $\frac{1}{2}$ inch throughout its length.

2. A moving coil transducer in accordance with claim 1 wherein portions of said wire leads adjacent each of said ends are formed in loops between the point where the wires pass through the apertures in said diaphragm means and an attachment point on said rigid mounting structure, said loops being formed in a plane which includes the central axis of motion of said diaphragm means, and said wire leads being fixed to said rigid mounting structure between said attachment points and said terminal means.

* * * * *